United States Patent [19]

Goralnik

[11] Patent Number: 4,910,650

[45] Date of Patent: Mar. 20, 1990

[54] DROP DOWN DIFFUSER FRAME FOR A CEILING LIGHT FIXTURE

[75] Inventor: Jack C. Goralnik, St. Louis, Mo.

[73] Assignee: International Lighting Manufacturing Co., St. Louis, Mo.

[21] Appl. No.: 395,021

[22] Filed: Aug. 17, 1989

[51] Int. Cl.[4] ..... F21S 3/00

[52] U.S. Cl. ..... 362/147; 362/225; 362/365; 362/368

[58] Field of Search ..... 362/147, 225, 220, 217, 362/365, 367, 368

[56] References Cited

U.S. PATENT DOCUMENTS

| | | | |
|---|---|---|---|
| 2,331,774 | 6/1941 | Guth . | |
| 2,335,736 | 2/1942 | Campen . | |
| 2,365,614 | 3/1943 | Winkler et al. . | |
| 2,427,084 | 10/1944 | Alderman . | |
| 2,997,321 | 8/1961 | Bobrick | 362/225 |
| 3,064,851 | 11/1962 | Guigli | 220/18 |
| 3,158,330 | 11/1964 | Steenhoven | 362/225 |
| 3,790,774 | 2/1974 | Miller et al. . | |
| 4,222,093 | 9/1980 | Garcia et al. | 362/147 |
| 4,510,559 | 4/1985 | Kristofek | 362/269 |

*Primary Examiner*—Douglas Hart

*Attorney, Agent, or Firm*—Senniger, Powers, Leavitt and Roedel

[57] ABSTRACT

A diffuser frame of the type which suspends a diffuser under a ceiling light fixture which is mounted on a ceiling and has a position projecting generally downward from the ceiling. The ceiling light fixture portion has a lip projecting upward at an edge. The diffuser frame includes a torsion spring latch mounted on a first inner surface the diffuser frame and supporting tongues mounted on a second inner surface of the diffuser frame. The torsion spring latch can be latchingly connected to the ceiling light fixture for holding the diffuser frame in a closed position in which the diffuser and diffuser frame substantially enclose the ceiling light fixture with the diffuser frame generally abutting the ceiling. The tongues rest on the lip generally at its upper edge for supporting the diffuser frame on one side in the closed position. The diffuser frame moves to an open position when the torsion spring latch is disconnected from the ceiling light fixture. The disconnection of the torsion spring latch permits the diffuser frame to drop generally downwardly with each tongue sliding on the upper edge of the lip of the ceiling light fixture. This motion spaces the diffuser frame from the ceiling. The tongues have catches which engage the lip to stop the sliding of the tongues. The diffuser frame may then swing to its open position with the tongues pivoting on the lip.

19 Claims, 2 Drawing Sheets

DROP DOWN DIFFUSER FRAME FOR A CEILING LIGHT FIXTURE

BACKGROUND OF THE INVENTION

This invention relates generally to frames which suspend diffusers under a ceiling light fixtures and more particularly to a drop-down diffuser frame which is swung open to access the light fixture.

Light fixtures which are mounted on a ceiling and project down from the ceiling are typically enclosed by a variety of devices, such as a diffuser frame which conceals the sides of the light fixture and a diffuser panel held by the frame which conceals the bottom of the fixture. To provide for access to the fixture, the frame must be removed or otherwise displaced, which often requires the use of two hands. This is inconvenient and may even Present a safety problem, especially since the person performing the maintenance is usually standing on a ladder. Moreover, replacement of the diffuser in its original position after the maintenance has been performed is often difficult.

SUMMARY OF THE INVENTION

Among the several objects of this invention includes the provision of a diffuser frame for a ceiling light fixture which can be quickly and easily mounted on the ceiling light fixture; the provision of such a diffuser frame which encloses and conceals the ceiling light fixture when in a closed position; the provision of such a diffuser frame which may easily be opened to access the ceiling light fixture while the frame remains attached to the fixture; the provision of such a diffuser frame which is easily retrieved to its closed position; the provision of such a diffuser frame of simple design which is economical to manufacture.

Generally, a diffuser frame of this invention suspends a diffuser under a ceiling light fixture of the type which has a portion projecting generally downward from the ceiling and a lip projecting upward at an edge thereof. The diffuser frame comprises a plurality of frame members disposed in the form of a closed geometric shape such as a rectangle or the like having an open bottom and an open top. The diffuser frame includes spring latch mounted on an inner surface of a first one of the frame members, and support means mounted on an inner surface of a second one of said frame members. The spring latch means is adapted for latching connection to the ceiling light fixture for holding the diffuser frame in a closed position in which the diffuser and diffuser frame substantially enclose the ceiling light fixture with the frame members generally abutting the ceiling. The support means includes a ramp portion and a catch portion. The ramp portion is adapted to rest on the ceiling light fixture lip generally at its upper edge for supporting the diffuser frame on one side in its closed position with the catch portion disposed above and inward of the lip.

The diffuser frame is adapted for movement to an open position by disconnecting the spring latch means from the ceiling light fixture, which permits the diffuser frame to drop generally downwardly with respect to the ceiling light fixture with the ramp portion sliding on the upper edge of the lip of the ceiling light fixture in a direction generally transverse to the upper edge of the lip thereby spacing the frame members from the ceiling. The catch portion is engageable with the lip to stop the sliding of the ramp portion on the lip. The diffuser frame is then adapted to swing to its open position with the support means pivotinq on the lip and with the frame members having sufficient clearance from the ceiling to allow the diffuser frame to swing to its open position without engaging the ceiling.

Another aspect of this invention involves a diffuser frame of the type described, above in combination with a ceiling light including a reflection having the stated portion projecting downward from the ceiling.

Other objects and features will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION OF A PREFERRED EMBODIMENT

Figure 1:
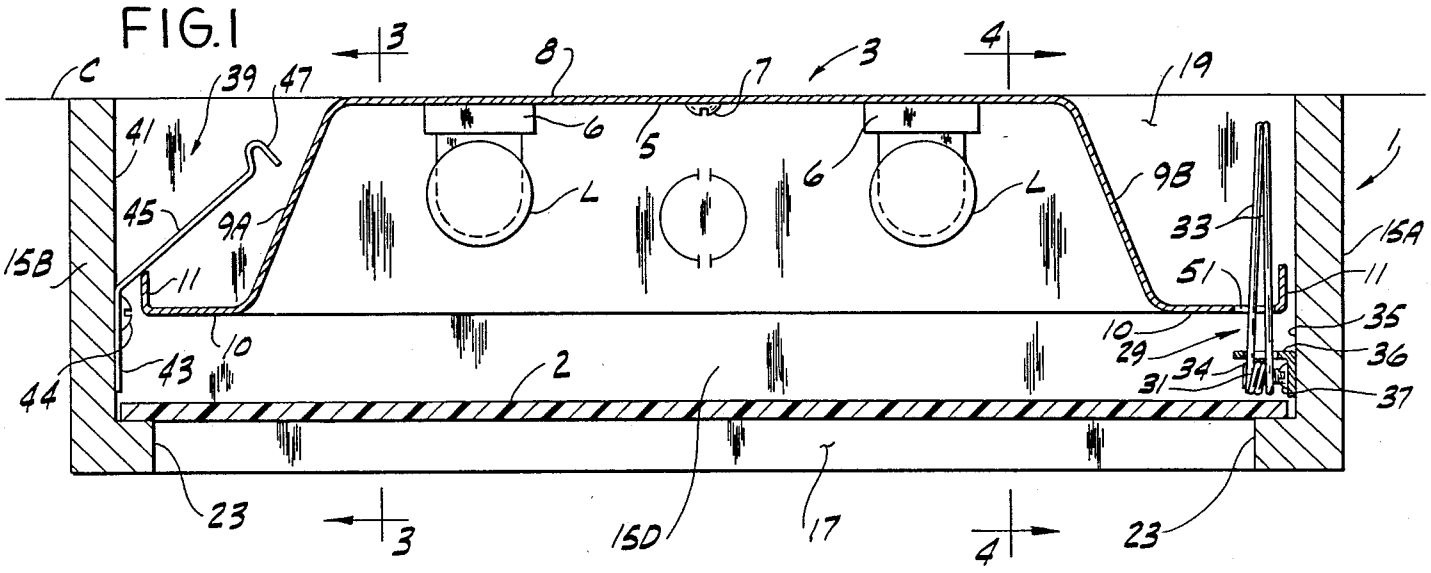
FIG. 1 is a cross section of a diffuser frame of the present invention shown as mounted on a ceiling light fixture in a closed position.

Referring now to the drawings, a diffuser frame, indicated generally at 1, suspends a diffuser 2 under a ceiling light fixture, generally indicated at 3, of the type which includes a reflector 5, means 6 for mounting (fluorescent) lamps L on the ceiling light fixture and means 7 mounting the reflector on a ceiling C. As illustrated, the reflector 5 is generally rectangular in shape, having a top wall 8 and opposing side walls 9A, 9B at opposite sides of the reflector. Each side wall 9A, 9B slopes downward and laterally outward from the top wall and each has a flange 10 at its lower edge projecting laterally outward in a plane generally parallel to the ceiling C. The outer marginal edge of this flange 10 is ben up to form a lip 11.

Figure 4:
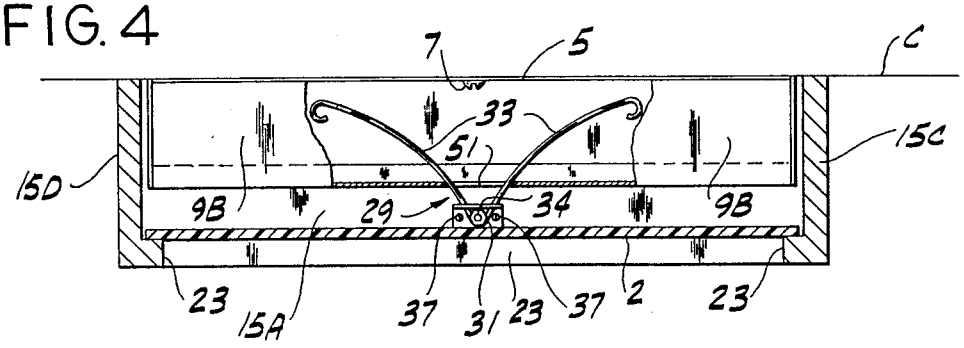
FIG. 4 is a vertical section of the diffuser frame taken in the plane including line 4—4 of FIG. 1 with portions of the reflector broken away to show the spring latch.

The diffuser frame 1 comprises a plurality of frame members 15A–15D disposed in the form of a closed geometric shape, in this embodiment a rectangle, having an open bottom 17 and an open top 19. The frame members 15A–15D have generally inwardly projecting lips each designated 23, adjacent the open bottom 17 of the diffuser frame on which a diffuser panel 2 rests for holding the diffuser in the frame. Spring latch means, generally indicated at 29, comprising a torsion spring 31 and integrally attached arms 33 projecting upward and diverging outward from the torsion spring, is mounted on a hub 34 (FIG. 4). The hub 34 is mounted on an inner surface 35 of a first one of the frame members 15A (the right frame member as viewed in FIG. 1) by a bracket 36 affixed to the inner surface 35 by screw fasteners 37. The torsion spring 31 constitutes spring means in this embodiment.

The diffuser frame 1 further includes support means, indicated generally at 39, mounted on an inner surface 41 of a second one of the frame member 15B. (The left frame member 1 as viewed in FIG. 1). The support means 39 comprises two tongues 43 mounted by suitable fasteners 44 at spaced intervals along the frame member 15B. Each tongue 43 is a generally rectangular strip of metal bent at one end and fastened to the frame member 15B by the fasteners 44. A ramp portion 45 of each tongue slopes generally upward and inward from the inner surface 41 of the frame member 15B in a plane intersecting the inner surface 41 at an acute angle, and a downward opening, hook-shaped section at the distal end of each tongue 43 forms a catch portion 47.

Figure 2:
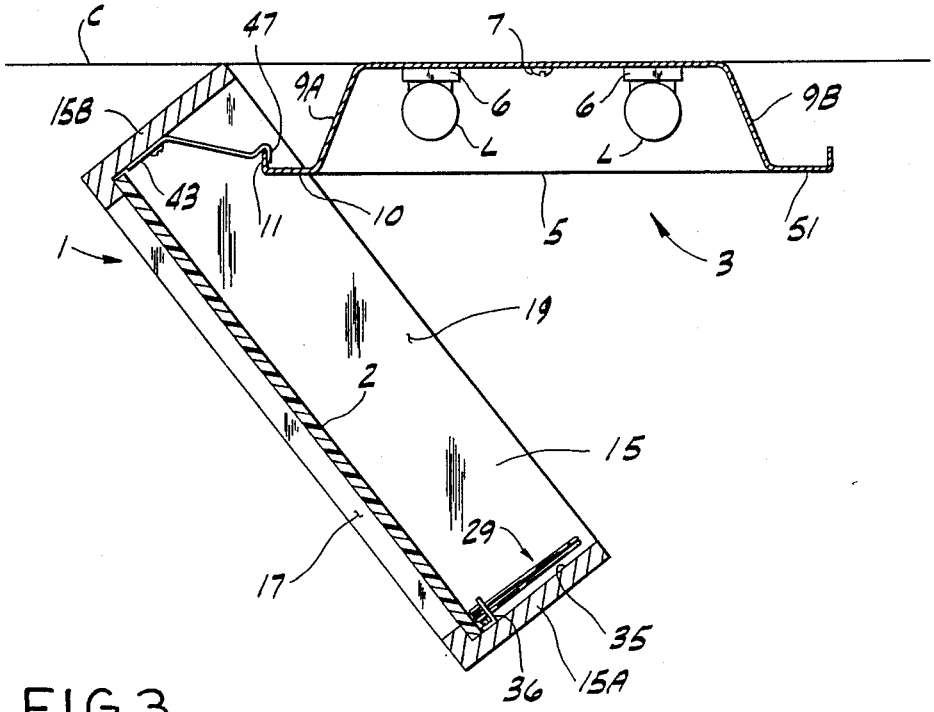
FIG. 2 is a view similar to FIG. 1 showing the diffuser frame swung down to an open position.
Figure 3:
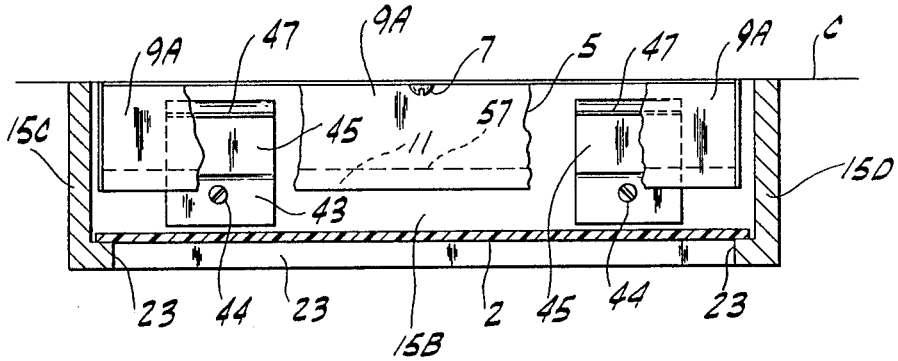
FIG. 3 is a vertical section of the diffuser frame taken in the plane including line 3—3 of FIG. 1 with portions of the reflector broken away to show the supporting tongues.

The spring latch means 29 is adapted for latching connection to the reflector 5 by insertion of the arms 33 through an opening 51 in the flange 10 of side wall 9B of the reflector. When connected to the reflector 5, the spring latch means holds the diffuser frame 1 in a closed position (FIG. 1) in which the diffuser panel 2 and diffuser frame 1 substantially enclose and conceal the ceiling light fixture 3 with the frame members 15A-15D generally abutting the ceiling C. When the diffuser frame is in its closed position, the ramp portions 45 of the tongues 43 rest on the upper edge 57 of the reflector lip 11 adjacent side wall 9A for supporting the diffuser frame 1 at one side thereof with the catch portion 47 being disposed above and inward of the lip. The diffuser frame 1 is opened (see FIG. 2) by disconnecting the spring latch means 29 from the ceiling light fixture 3. This permits the diffuser frame 1 to drop generally downwardly with respect to the reflector 5, with the ramp portions 45 of the tongues 43 sliding on the upper edge 57 of the stated reflector lip 11 in a direction transverse to the upper edge of the lip. This motion spaces the frame members 15A–D from the ceiling.

The catch portions 47 of the tongues 43 are engageable with the lip 11 to stop the sliding of the ramp portions 45 on the lip. After the catch portions 47 halt the sliding motion of the ramp portions 45, the diffuser frame 1 is adapted to swing to its open position with the tongues 43 pivoting on said lip 11 generally at the intersection of the ramp portion 45 and the catch portion 47. The swinging motion is halted when the frame member 15B on which the tongues are mounted engages the ceiling C. However, the sliding motion of the sloped ramp portions 45 on the upper edge 57 of the lip 11 drops the diffuser frame 1 down before its swinging motion occurs so that the frame member 15B has sufficient clearance from the ceiling C to allow the diffuser frame 1 to swing to an open position which provides access to the ceiling light fixture 3 for changing the lamps L or making repairs to the ceiling light fixture. The diffuser frame 1 is supported on the reflector 5 in its open position by the tongues 43.

The diffuser frame 1 may be returned to its closed position by manually swinging the diffuser frame 1 toward its closed position an lifting the frame upward until the spring latch means 29 is generally adjacent the opening 51 in the reflector 5. The arms 33 of the spring latch means 29 are adapted for movement from a first position in which the distal ends of the arms are relatively close together, to a second position in which the distal ends of the arms are farther apart from each other. The torsion spring 31 biases the arms toward the second position. The diffuser frame 1 is adapted to be moved to its closed position from its open position by forcing the arms 33 to the first position against the bias of the torsion spring 31 with the distal ends of the arms being receivable upwardly through the opening 51 in the reflector 5. When the force holding the arms 33 together is relieved, the arms engage opposite edges of the aperture 51. As the diverging arms 33 move under the bias of the torsion spring 31 from the first position to the second position, the diffuser frame 1 is pulled upward by the arms with the ramp portion 45 sliding on the reflector lip 11 upward and laterally inward with respect to the reflector 5 to bring the diffuser frame 1 to its closed position.

Because the diffuser frame 1 remains supported by the reflector 5 when in its open position, it does not have to be held when opened by the person accessing the ceiling light fixture 3. This eliminates any safety risk to a person standing on a ladder. The diffuser frame 1 is also easily installed on a ceiling light fixture 3 by lifting one side of the diffuser frame so that the catch portions 47 of the tongues 43 may be hooked on the reflector lip 11, and then swinging the diffuser frame up to its closed position as previously described.

As various changes could be made in the above constructions without departing from the scope of the invention, it is intended that all matter contained in the above description or shown in the accompanying drawings shall be interpreted as illustrative and not in a limiting sense.

What is claimed is:

1. A diffuser frame for suspending a diffuser under a ceiling light fixture mounted on a ceiling, said light fixture having a portion projecting generally downward from the ceiling and a lip projecting upward at an edge thereof, the diffuser frame comprising a plurality of frame members disposed in the form of a closed geometric shape such as a rectangle having an open bottom and an open top, spring latch means mounted on an inner surface of a first one of said frame members, and support means mounted on an inner surface of a second one of said frame members, said spring latch means being adapted for latching connection to the ceiling light fixture for holding the diffuser frame in a closed position in which the diffuser and diffuser frame substantially enclose the ceiling light fixture with said frame members generally abutting the ceiling, said support mean including a ramp portion and a catch portion, said ramp portion being adapted to rest on said ceiling light fixture lip generally at its upper edge for supporting the diffuser frame at one side thereof in said closed position with said catch portion being disposed above and inward of said lip, the diffuser frame being adapted for movement to an open position by disconnecting said spring latch means from the ceiling light fixture thereby permitting the diffuser frame to drop generally downwardly with respect to the ceiling light fixture with said ramp portion of said support means sliding on the upper edge of said lip of the ceiling light fixture in a direction generally transverse to the upper edge of said lip thereby spacing said frame members from the ceiling, said catch portion being engageable with said lip thereby to stop the sliding of said ramp portion on said lip, the diffuser frame then being adapted to swing to said open position with said support means pivoting on said lip and with said frame members having sufficient clearance from the ceiling to allow the diffuser frame to swing to said open position.

2. The diffuser frame as set forth in claim 1 wherein said spring latch means comprises spring means and two arms associated with said spring means, the arms projecting upward and diverging outward from said spring means, the arms being adapted for movement from a first position in which the distal ends of the arms are relatively close together, to a second position in which the distal ends of the arms are spaced farther apart from each other, said spring means biasing the arms toward said second position whereby the diffuser frame is adapted to be moved to said closed position from said open position by forcing the arms to said first position against the bias of said spring means with the distal ends of the arms being receivable upwardly through an aperture in the ceiling light fixture, the arms engaging edges of the aperture as said spring mean biases the arms to move from said first position to said second position when the force on the arms is relieved thereby pulling the diffuser frame upward with said ramp portion sliding upward and laterally inward with respect to the ceiling light fixture on said lip of the ceiling light fixture to bring the diffuser frame to said closed position.

3. The diffuser frame as set forth in claim 2 wherein said spring means comprises a torsion spring to which the arms are integrally attached.

4. The diffuser frame as set forth in claim 1 wherein said support means comprises a plurality of tongues mounted at intervals along said second frame member, each tongue having a section forming said ramp portion sloping generally upward and inward from the inner surface of said second frame member generally in a plane intersecting the inner surface at an acute angle, and a hook-shaped section at the distal end of the tongue forming said catch portion.

5. The diffuser frame as set forth in claim 1 wherein said diffuser frame comprises four frame members disposed in a rectangle.

6. A ceiling light comprising light fixture means adapted for mounting on a ceiling, said light fixture means including a portion projecting generally downward from the ceiling and a lip projecting upward at an edge thereof, and a diffuser frame for suspending a diffuser under said light fixture mean,, the diffuser frame comprising a plurality of frame members disposed in the form of a closed geometric shape such as a rectangle the having an open bottom and an open top, spring latch means mounted on an inner surface of a first one of said frame members, and support means mounted on an inner surface of a second one of said frame members, said spring latch means being adapted for latching connection to said light fixture means for holding the diffuser frame in a closed position in which the diffuser and diffuser frame substantially enclose said light fixture means with said frame members generally abutting the ceiling, said support means including a ramp portion and a catch portion, said ramp portion being adapted to rest on said light fixture means lip generally at its upper edge for supporting he diffuser frame at one side thereof in said closed position with said catch portion being disposed above and inward of said lip, the diffuser frame being adapted for movement to an open position by disconnecting said spring latch means from said light fixture means thereby permitting the diffuser frame to drop generally downwardly with respect to said light fixture means with said ramp portion of said support means sliding on the upper edge of said lip of said light fixture means in a direction generally transverse to the upper edge of said lip thereby spacing said frame members from the ceiling, said catch portion being engageable with said lip thereby to stop the sliding of said ramp portion on said lip, the diffuser frame then being adapted to swing to said open position with said support means pivoting on said lip and with said frame members having sufficient clearance from the ceiling to allow the diffuser frame to swing to said open position.

7. The ceiling light as set forth in claim 6 wherein said spring latch means comprises spring means and two arms associated with said spring means, the arms projecting upward and diverging outward from said spring means, and wherein said light fixture means has an aperture, the arms being adapted for movement from a first position in which the distal ends of the arms are relatively close together, to a second position in which the distal ends of the arms are spaced relatively farther apart from each other, said spring means biasing the arms toward said second position whereby the diffuser frame is adapted to be moved to said closed position from said open position by forcing the arms to said first position against the bias of said spring means with the distal ends of the arms being receivable upwardly through said light fixture means aperture, the arms engaging edges of the aperture as said spring means biases the arms to move from said first position to said second position when the force on the arms is relieved thereby pulling the diffuser frame upward with said ramp portion sliding upward and laterally inward with respect to said light fixture means on said lip of said light fixture means to bring the diffuser frame to said closed position.

8. The ceiling light as set forth in claim 7 wherein said spring means comprises a torsion spring to which the arms are integrally attached.

9. The ceiling light as set forth in claim 6 wherein said support means comprises a plurality of tongues mounted at intervals along said second frame member, each tongue having a section forming said ramp portion sloping generally upward and inward from the inner surface of said second frame member generally in a plane intersecting the inner surface at an acute angle, and a hook-shaped section at the distal end of the tongue forming said catch portion.

10. The ceiling light as set forth in claim 6 wherein the diffuser frame comprises four frame members disposed in a rectangle.

11. A ceiling light comprising a reflector, means mounting the reflector to a ceiling, the reflector including a portion projecting generally downward from the ceiling and a lip projecting upward at an edge thereof, means for mounting a lamp on the reflector, a diffuser, and a diffuser frame for suspending the diffuser under the lamps mounted on the reflector, the diffuser frame comprising a plurality of frame members disposed in the form of a closed geometric shape such as a rectangle having an open bottom and an open top, spring latch means mounted on an inner surface of a first one of said frame members, and support means mounted on an inner surface of a second one of said frame members, said spring latch means being adapted for latching connection to the reflector for holding the diffuser frame in a closed position in which the diffuser and diffuser frame substantially enclose the reflector and lamps mounted thereon with said frame members generally abutting the ceiling, said support means including a ramp portion and a catch portion, said ramp portion being adapted to rest on the reflector lip generally at its upper edge for supporting the diffuser frame at one side thereof in said closed position with said catch portion being disposed above and inward of the lip, the diffuser frame being adapted for movement to an open position by disconnecting said spring latch means from the reflector thereby permitting the diffuser to drop generally downward and laterally with respect to the reflector with said ramp portion of said support means sliding on the upper edge of the lip of the reflector in a direction generally transverse to said upper edge of the lip thereby spacing said frame members from the ceiling, said catch portion being engageable with the lip thereby to stop the sliding of said ramp portion on the lip, the diffuser frame then being adapted to swing to said open position with said catch portion pivoting on the lip and with said frame members having sufficient clearance from the ceiling to allow the diffuser frame to swing to said open position.

12. The ceiling light as set forth in claim 11 wherein said spring latch means comprises spring means and two arms associated with said spring means, the arms Projecting upward and diverging outward from said spring means, and wherein the reflector has an aperture, the arms being adapted for movement from a first position in which the distal ends of the arms are relatively close together, to a second position in which the distal ends of the arms are spaced relatively farther apart from each other, said spring means biasing the arms toward said second position whereby the diffuser frame is adapted to be moved to said closed position from said open position by forcing the arms to said first position against the bias of said spring means with the distal ends of the arms being receivable upwardly through the reflector aperture, the arms engaging edges of the reflector aperture as said spring means biases the arms to move from said first position to said second position when the force on the arms is relieved thereby pulling the diffuser frame upward with said ramp portion sliding upward and laterally inward with respect to the reflector on the lip of the reflector to bring the diffuser frame to said closed position.

13. The ceiling light as set forth in claim 12 wherein said spring means comprises a torsion spring to which the arms are integrally attached.

14. The ceiling light as set forth in claim 11 wherein said support means comprises a plurality of tongues mounted at intervals along said second frame member, each tongue having a section forming said ramp portion sloping generally upward and inward from the inner surface of said second frame member generally in a plane intersecting the inner surface at an acute angle, and a hook-shaped section at the distal end of the tongue forming said catch portion.

15. The ceiling light as set forth in claim 11 wherein the diffuser frame comprises four frame members disposed in a rectangle.

16. A ceiling light comprising a reflector, means mounting the reflector to a ceiling, the reflector including a portion projecting generally downward from the ceiling and a lip projecting upward at an edge thereof, means for mounting a lamp on the reflector, a diffuser, and a diffuser frame for suspending the diffuser under the lamps mounted on the reflector, the diffuser frame comprising a plurality of frame members disposed in the form of a closed geometric shape such as a rectangle having an open bottom and an open top, spring latch means mounted on an inner surface of a first one of said frame members, a plurality of tongues mounted at intervals along an inner surface of a second one of said frame members, each tongue having a section forming a ramp portion sloping generally upward and inward from the inner surface of said second frame member generally in a plane intersecting the inner surface at an acute angle, and a hook-shaped section at the distal end of the tongue forming a catch portion, said ramp portion being adapted to rest on the reflector lip generally at its upper edge for supporting the diffuser frame at one side thereof in said closed position with said catch portion being disposed above and inward of the lip, the diffuser frame being adapted for movement to an open position by disconnecting said spring latch means from the reflector thereby permitting the diffuser to drop generally downward and laterally with respect to the reflector with said ramp portion of said support means sliding on the upper edge of the lip of the reflector in a direction generally transverse to said upper edge of the lip thereby spacing said frame members from the ceiling, said catch portion being engageable with the lip thereby to stop the sliding of said ramp portion on the lip, the diffuser frame then being adapted to swing to said open position with said catch portion pivoting on the lip and with said frame members having sufficient clearance from the ceiling to allow the diffuser frame to swing to said open position.

17. The ceiling light as set forth in claim 16 wherein said spring latch means comprises spring means and two arms associated with said spring means, the arms projecting upward and diverging outward from said spring means, and wherein the reflector has an aperture, the arms being adapted for movement from a first position in which the distal ends of the arms are relatively close together, to a second position in which the distal ends of the arms are spaced relatively farther apart from each other, said spring means biasing the arms toward said second position whereby the diffuser frame is adapted to be moved to said closed position from said open position by forcing the arms to said first position against the bias of said spring means with the distal ends of the arms being receivable upwardly through the reflector aperture, the arms engaging edges of the reflector aperture the spring means biases as the arms to move from said first position to said second position when the force on the arms is relieved thereby pulling the diffuser frame upward with said ramp portion sliding upward and laterally inward with respect to the reflector on the lip of the reflector to bring the diffuser frame to said closed position.

18. The ceiling light as set forth in claim 17 wherein said spring means comprises a torsion spring to which the arms are integrally attached.

19. The ceiling light as set forth in claim 16 the diffuser frame comprises four frame members disposed in a rectangle.

* * * * *